US009342023B1

(12) United States Patent
Osaki et al.

(10) Patent No.: US 9,342,023 B1
(45) Date of Patent: May 17, 2016

(54) IMAGE FORMING APPARATUS

(71) Applicant: KYOCERA Document Solutions Inc., Osaka (JP)

(72) Inventors: Shuji Osaki, Osaka (JP); Hiroshi Inui, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/943,434

(22) Filed: Nov. 17, 2015

(30) Foreign Application Priority Data

Nov. 28, 2014 (JP) ..... 2014-240815

(51) Int. Cl.
*G03G 15/00* (2006.01)

(52) U.S. Cl.
CPC ..... *G03G 15/6552* (2013.01); *G03G 15/80* (2013.01)

(58) Field of Classification Search
CPC ..... G03G 15/6552
USPC ..... 399/405
See application file for complete search history.

(56) References Cited

U.S. PATENT DOCUMENTS 6,397,028 B1 * 5/2002 Nakamura ..... G03G 21/1638 399/124
7,748,705 B2 * 7/2010 Yamada ..... B65H 31/02 271/209
8,849,180 B2 * 9/2014 Kimura ..... G03G 21/20 271/279
2001/0009625 A1 * 7/2001 Tamehira ..... B41J 13/106 399/405
2002/0150403 A1 * 10/2002 Katsuyama ..... H04N 1/00525 399/107
2005/0244204 A1 * 11/2005 Seo ..... G03G 15/6552 399/405
2006/0193668 A1 * 8/2006 Akiyama ..... G03G 15/6552 399/405
2008/0290590 A1 * 11/2008 Mizuguchi ..... B65H 31/02 271/207

FOREIGN PATENT DOCUMENTS

JP 2011-137900 7/2011

* cited by examiner

*Primary Examiner* — Anthony Nguyen
(74) *Attorney, Agent, or Firm* — Wenderoth, Lind & Ponack, L.L.P.

(57) ABSTRACT

An image forming apparatus includes a protruding tray part. The protruding tray part is provided on the upper surface portion of a body casing part, extends in a paper discharge direction and has a convex shape which becomes convex at an upper side, and supports a part of a lower surface of a paper, which is discharged from a paper discharge port, from below, thereby forming a space between end portions of the paper and the upper surface portion of the body casing part. The paper conveying device is formed at a lower surface thereof with a guide recessed part. The guide recessed part has a concave shape corresponding to the convex shape of the protruding tray part, and is engaged with the convex shape to guide the paper conveying device when the paper conveying device is mounted in the in-body paper discharge space.

4 Claims, 6 Drawing Sheets

IMAGE FORMING APPARATUS

CROSS-REFERENCE TO RELATED APPLICATION

This application is based upon and claims the benefit of priority from Japanese Patent Application No. 2014-240815 filed on Nov. 28, 2014, the entire contents of which are incorporated herein by reference.

BACKGROUND

The technology of the present disclosure relates to an in-body paper discharge type image forming apparatus.

Conventionally, there has been known an in-body paper discharge type image forming apparatus having an in-body paper discharge space between a body casing part accommodating an image forming unit and a scanner casing part arranged at an upper side of the body casing part. In this image forming apparatus, the body casing part and the scanner casing part are connected to each other via a connection casing part. The connection casing part is formed with a paper discharge port, and a paper subjected to an image forming process by the image forming unit is discharged to the in-body paper discharge space from the aforementioned paper discharge port. There is a case in which a post-processing apparatus for performing a post-process (for example, a stapling process) on the paper subjected to the image formation is arranged at a lateral side of the body casing part. In this case, a paper conveying device for conveying the paper discharged from the paper discharge port to the post-processing apparatus is necessary. Therefore, there has been proposed an image forming apparatus in which the paper conveying device is attachable to and detachable from the in-body paper discharge space.

SUMMARY

An image forming apparatus according to one aspect of the present disclosure includes a body casing part, a scanner casing part, a connection casing part, and an in-body paper discharge space. The body casing part accommodates an image forming unit which performs an image forming process on a paper. The scanner casing part is provided above the body casing part. The scanner casing part accommodates an image reading unit. The connection casing part has a paper discharge port for discharging the paper subjected to the image forming process. Furthermore, the connection casing part connects the body casing part to the scanner casing part. The in-body paper discharge space is surrounded by a wall part formed with the paper discharge port in the connection casing part, an upper surface portion of the body casing part, and a bottom surface portion of the scanner casing part. The in-body paper discharge space is configured such that a paper conveying device is detachable.

Furthermore, the image forming apparatus further includes a protruding tray part. The protruding tray part is provided on the upper surface portion of the body casing part. The protruding tray part extends in a paper discharge direction and has a convex shape projecting upward when viewed from the paper discharge direction. The protruding tray part supports a part of a lower surface of the paper, which is discharged from the paper discharge port, from below, thereby forming space between end portions of the paper and the upper surface portion of the body casing part. The paper conveying device is formed at a lower surface thereof with a guide recessed part. The guide recessed part has a concave shape corresponding to the convex shape of the protruding tray part. When the paper conveying device is mounted in the in-body paper discharge space, the guide recessed part is engaged with the protruding tray part to guide the paper conveying device.

DETAILED DESCRIPTION

Hereinafter, an example of an embodiment of the technology of the present disclosure will be described in detail on the basis of the drawings. It is noted that the technology of the present disclosure is not limited to the following embodiment.

Embodiment

Figure 1:
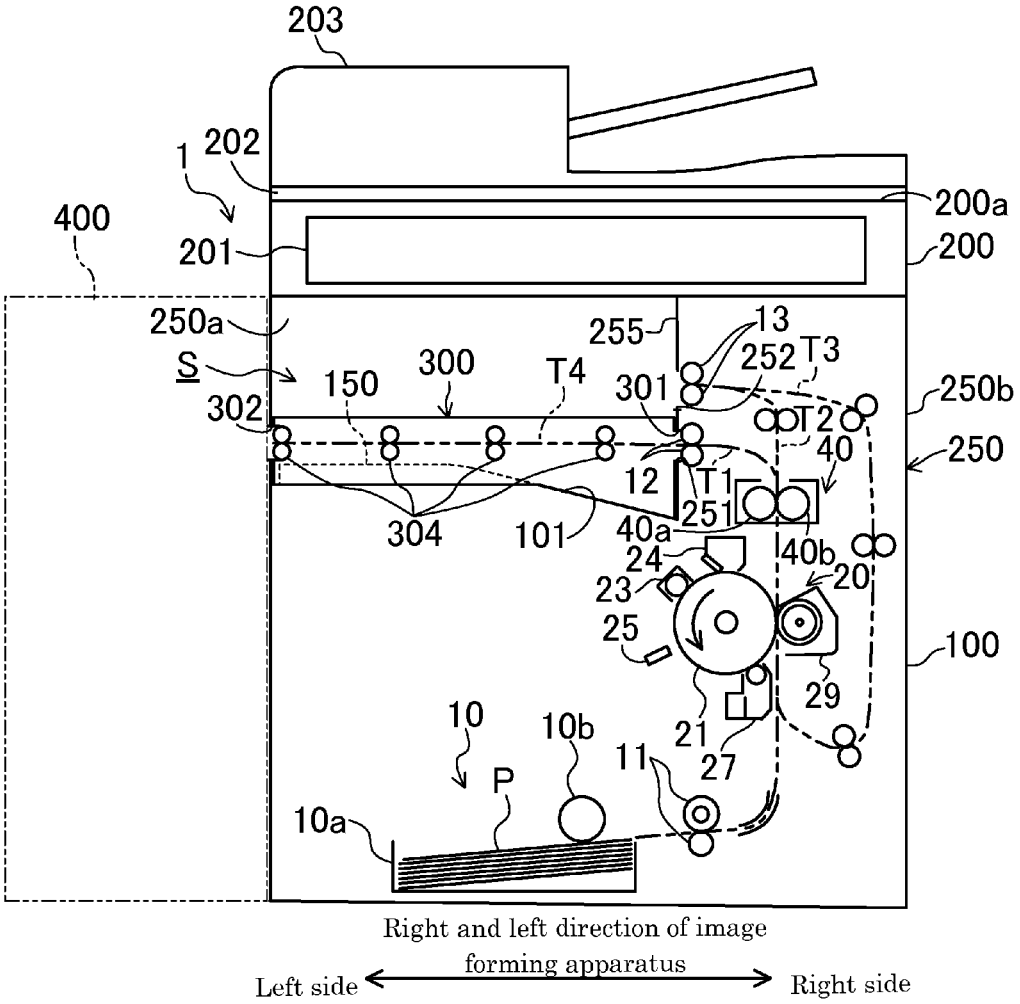
FIG. 1 is a schematic sectional view illustrating an internal structure of an image forming apparatus in an embodiment.

FIG. 1 illustrates a digital copy machine which is an example of an image forming apparatus 1 in the present embodiment. In the following description, unless otherwise specifically mentioned, a "front side" and a "rear side" indicate a front side and a rear side of the image forming apparatus 1, and a "left side" and a "right side" indicate a left side and a right side when the image forming apparatus 1 is viewed from the front side.

The aforementioned image forming apparatus 1 is a so-called in-body paper discharge type copy machine and has a body casing part 100, a scanner casing part 200, and a connection casing part 250. In the scanner casing part 200, an image reading unit 201 for reading a document image is accommodated, and in the body casing part 100, an image forming unit 20 and a fixing unit 40 for printing the document image read by the image reading unit 201 on a paper P are accommodated. The scanner casing part 200 is arranged above the body casing part 100. The body casing part 100 and the scanner casing part 200 are connected to each other via the connection casing part 250. The connection casing part 250 has a rear connection casing part 250*a* extending upward from a rear end portion of an upper part of the body casing part 100 and a right connection casing part 250*b* extending upward from a right end portion of the upper part of the body casing part 100. Between the body casing part 100 and the scanner casing part 200, an in-body paper discharge space S is formed. In the right connection casing part 250*b*, a vertical wall part 255 facing the in-body paper discharge space S is formed with a first paper discharge port 251 and a second paper discharge port 252 vertically arranged in a row. In the in-body paper discharge space S, a paper discharge device 300 is configured to be attachable and detachable. From a rear end portion in the vertical wall part 255 of the aforementioned right connection casing part 250*b*, a supply-side electrical connector 253 for supplying power to the paper discharge device 300 is exposed. The paper discharge device 300 is a relay device for conveying the paper P subjected to image formation and discharged from the first paper discharge port 251 to a post-processing apparatus 400. The post-processing apparatus 400 is mounted at the left side of the image forming apparatus 1 in the present embodiment, and performs a post-process such as a staple process on papers subjected to image formation.

An upper surface 200*a* of the aforementioned scanner casing part 200 is covered by a document cover 202 so as to be openable/closable. The image reading unit 201 accommodated in the scanner casing part 200 optically reads a document placed on the upper surface 200*a* of the aforementioned scanner casing part 200, and generates image data thereof. The image data generated by the image reading unit 201 is stored in a data storage unit (not illustrated). The document cover 202 is integrally provided with a document conveying device 203 that conveys the document toward the image reading unit 201.

The aforementioned body casing part 100 is formed in an approximately rectangular parallelepiped shape and the aforementioned image forming unit 20 is arranged near an upper right side of the body casing part 100. The image forming unit 20 is provided at an upper side thereof with the fixing unit 40, and is provided at a lower left side thereof with a paper feeding unit 10. The paper feeding unit 10 has a paper feeding cassette 10*a* in which the paper P having a sheet shape is accommodated, and a pick-up roller 10*b* for taking out the paper P in the paper feeding cassette 10*a* and sending the paper P to an exterior of the cassette. The paper P sent to the exterior of the cassette by the paper feeding cassette 10*a* is supplied to the image forming unit 20 via a conveying roller pair 11.

The image forming unit 20 has a photosensitive drum 21, a charging device 23, an exposure device 25, a developing device 27, and a transfer device 29. In the image forming unit 20, a peripheral surface of the photosensitive drum 21 is firstly charged by the charging device 23, laser light based on the document image data (the image data of the document image generated by the image reading unit 201) is irradiated to the surface of the photosensitive drum 21 by the exposure device 25 to generate an electrostatic latent image, then the formed electrostatic latent image is developed by the developing device 27 to form a toner image, and subsequently, the aforementioned toner image is transferred to the paper P supplied from the paper feeding unit 10 by the transfer device 29 and the paper P subjected to the transfer is supplied to the fixing unit 40. It is noted that a reference numeral 24 of FIG. 1 indicates a cleaning unit that removes remaining toners remained on the surface of the photosensitive drum 21.

The aforementioned fixing device 40 has a fixing roller 40*a* and a pressing roller 40*b*. The fixing roller 40*a* is heated by an internal heater. In the fixing device 40, the paper P supplied by the image forming unit 20 is pressed and heated between the fixing roller 40*a* and the pressing roller 40*b*, so that the toner image is fixed to the paper P. Then, the paper P with the toner image fixed by the fixing device 40 is conveyed upward by both rollers 40*a* and 40*b*. A conveyance path, through which the paper P is conveyed, is branched into a first conveyance path T1 and a second conveyance path T2 at an upper side of the fixing device 40, and papers sent by both rollers 40*a* and 40*b* are supplied to the first conveyance path T1 or the second conveyance path T2.

The first conveyance path T1 is curved leftward and upward from the fixing device 40 and is connected to the aforementioned first paper discharge port 251. In the vicinity of the first paper discharge port 251 of the first conveyance path T1, a discharge roller 12 for discharging the paper P is arranged. The second conveyance path T2 extends upward from the fixing device 40, is then bent leftward, and is connected to the aforementioned second paper discharge port 252. In the vicinity of the second paper discharge port 252 of the second conveyance path T2, a discharge•inversion roller 13 for discharging or switching back the paper P is arranged. A conveyance path T3 for duplex printing for switching back the paper P and supplying the paper P to the image forming unit 20 again when duplex printing is performed on the paper P is further connected to the aforementioned second conveyance path T2.

In the state in which the paper discharge device 300 has not been mounted in the in-body paper discharge space S, the paper P discharged from the first paper discharge port 251 is received in a paper tray 101 (an upper surface portion of the body casing part 100). It is noted that the second paper discharge port 252 is used at the time of switchback conveyance of papers and the like. On the other hand, in the state in which the paper discharge device 300 has been mounted in the in-body paper discharge space S (the state illustrated in FIG. 1), the paper P subjected to image formation and discharged from the first paper discharge port 251 is supplied to a relay conveyance path T4 in the paper discharge device 300.

The paper discharge device 300 is formed in an approximately rectangular parallelepiped shape viewed as a whole. The paper discharge device 300 is formed at a right wall thereof with a paper feeding port 301 communicating with the first paper discharge port 251, and is formed at a left wall thereof with a paper discharge port 302 communicating with a paper feeding port (not illustrated) of the post-processing apparatus 400. The paper discharge device 300 is provided therein with the aforementioned relay conveyance path T4. The relay conveyance path T4 extends nearly horizontally toward the paper discharge port 302 from the paper feeding port 301. The relay conveyance path T4 is formed by four conveying roller pairs 304.

Figure 2:
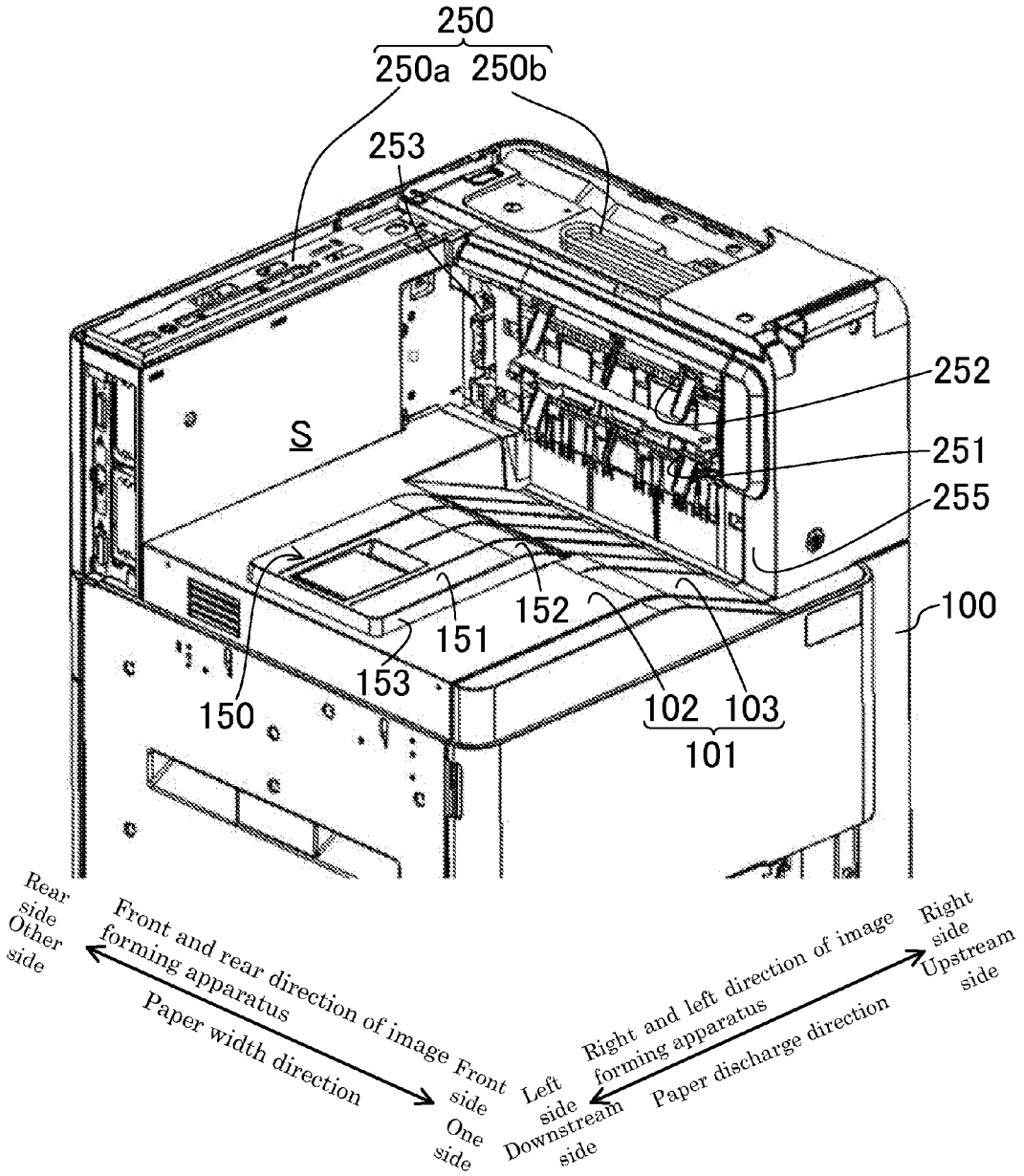
FIG. 2 is a perspective view illustrating the state in which a scanner casing part has been detached from an image forming apparatus.

The paper discharge device 300 is mounted on the paper tray 101 which is a bottom wall portion of the in-body paper discharge space S. As illustrated in FIG. 2, the paper tray 101 is formed by the upper surface portion of the body casing part 100. The paper tray 101 has a horizontal surface portion 102 and an inclination surface portion 103. The inclination surface portion 103 is formed right downward at a right end portion of the upper surface portion of the body casing part 100. As described above, the inclination surface portion 103 is provided, so that the paper P discharged from the first paper discharge port 251 can be allowed to slide downward along the inclination surface portion 103 and the end edge of the paper P can be aligned. The aforementioned horizontal surface portion 102 is connected to an upper end edge of the inclination surface portion 103. The aforementioned horizontal surface portion 102 is mounted with a protruding tray 150. Then, the paper discharged from the aforementioned first paper discharge port 251 is loaded across the inclination surface portion 103 of the paper tray 101 and the protruding tray 150.

Figure 6:
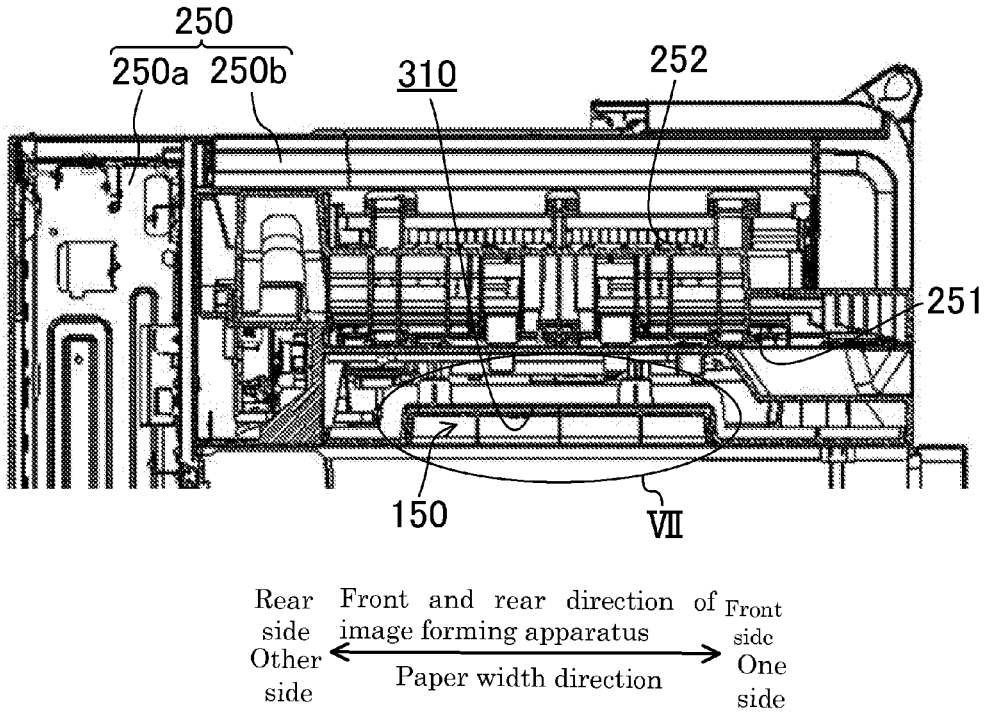
FIG. 6 is a sectional view taken along line VI-VI of FIG. 5.
Figure 7:
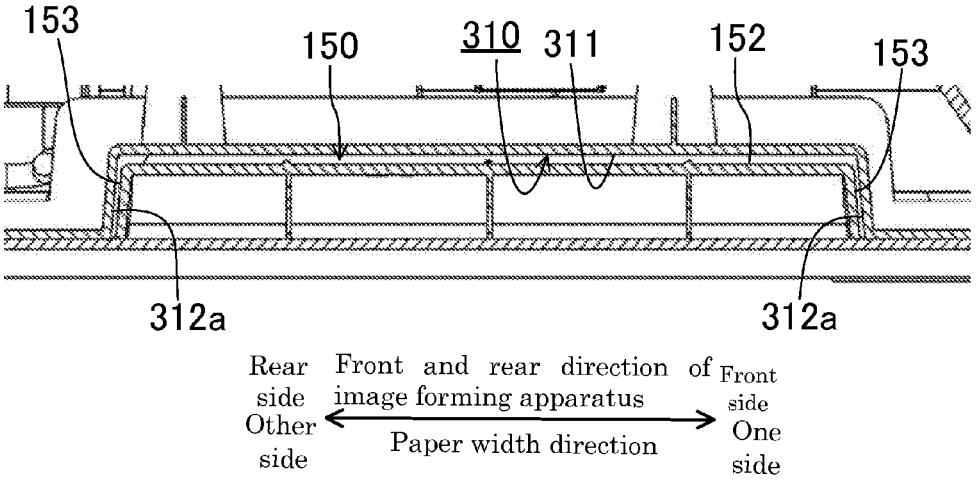
FIG. 7 is an enlarged view of a part VII of FIG. 6.

The aforementioned protruding tray 150 is formed so as to extend in a paper discharge direction (the right and left direction of the image forming apparatus 1) in a plan view. The protruding tray 150 has a convex shape (a rectangular shape in the present embodiment) which becomes convex upward with respect to the horizontal surface portion 102 when viewed from the paper discharge direction. The protruding tray 150 is detachable from the horizontal surface portion 102. The protruding tray 150 has a paper support surface 151, a connection surface 152, and a pair of side surfaces 153. The paper support surface 151 is a horizontal plane positioned above the horizontal surface portion 102 of the paper tray 101. The connection surface 152 is a surface which connects the paper support surface 151 to the inclination surface portion 103 of the paper tray 101. The connection surface 152 and the inclination surface portion 103 of the paper tray 101 are connected to each other and formed substantially flush with each other at the same inclination angle. The pair of side surfaces 153 are slightly inclined downward and outward from both end edges of the paper support surface 151 in a paper width direction (see FIG. 6 and FIG. 7). The protruding tray 150 is mounted at a center part of the horizontal surface portion 102 of the paper tray 101 in the paper width direction (a direction perpendicular to the paper discharge direction). The width of the protruding tray 150 is smaller than that of the paper P. Consequently, only a center portion of a front end part of the paper P discharged from the first paper discharge port 251 in the paper width direction is supported by the protruding tray 150. As a consequence, a space is formed between both end portions of the discharged paper P in the width direction and the horizontal surface portion 102 of the paper tray 101, so that a user can put his/her hand into these spaces and easily grab the paper P.

Figure 3:
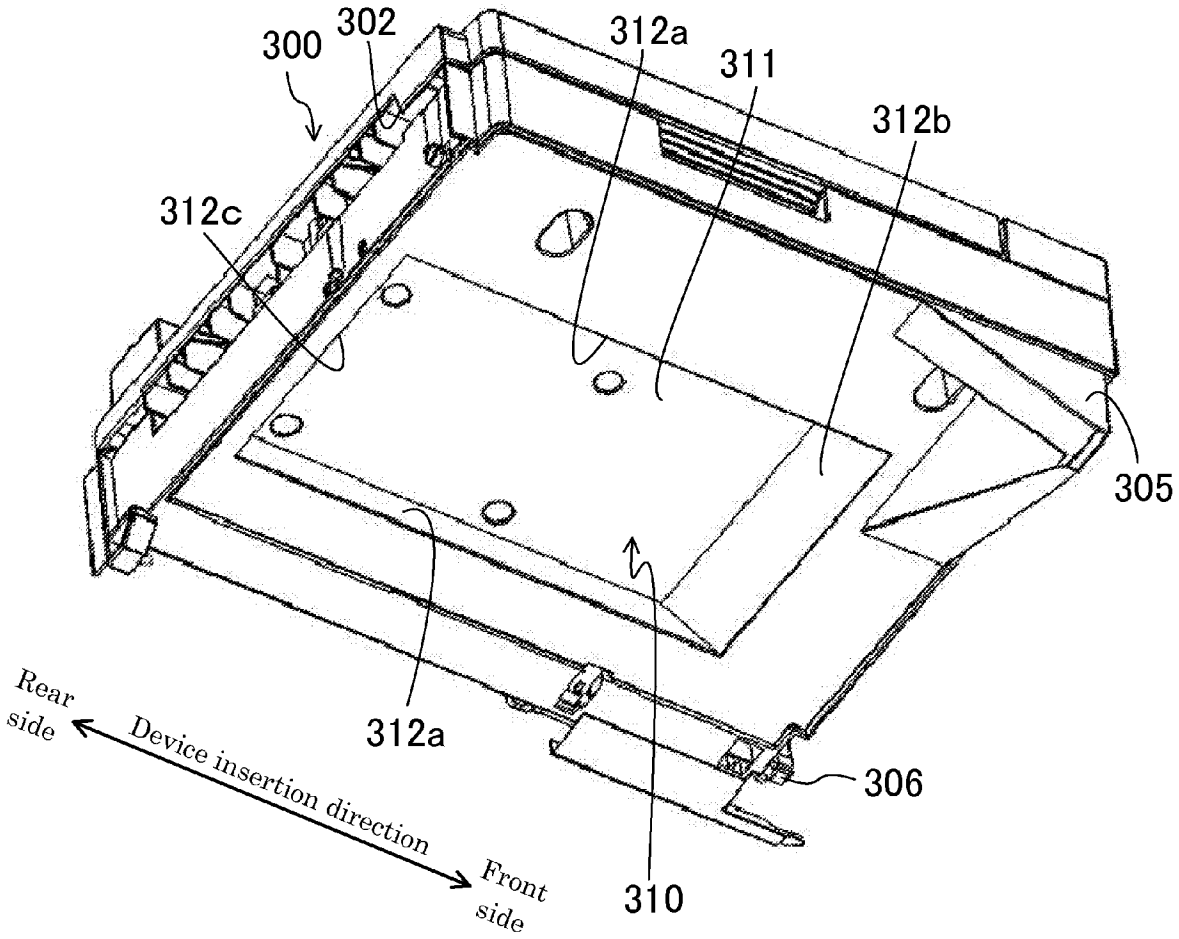
FIG. 3 is a perspective view of a paper conveying device when viewed from below.

The aforementioned paper discharge device 300 is inserted into the in-body paper discharge space S along the paper discharge direction from an outer side of the in-body paper discharge space S. As illustrated in FIG. 3, the paper discharge device 300 is formed at a lower surface thereof with a guide recessed part 310 for guiding the paper discharge device 300 when the paper discharge device 300 is inserted into the in-body paper discharge space S. The guide recessed part 310 is engaged with the protruding tray 150, thereby guiding the insertion of the paper discharge device 300. At a front end portion of the lower surface of the paper discharge device 300 in the device insertion direction, a lower projecting plate 305 is vertically installed. The lower projecting plate 305 is fitted into a V-shaped recessed part between the inclination surface portion 103 of the paper tray 101 and the vertical wall part 255 of the right connection casing part 250*b*, thereby performing the positioning of the paper discharge device 300 in the insertion direction. From a front surface of the paper discharge device 300 in the device insertion direction, an electrical connector 306 is exposed. The guide recessed part 310 guides the paper discharge device 300 such that the electrical connector 306 is fitted into the supply-side electrical connector 253 (see FIG. 2) exposed from the vertical wall part 255 of the right connection casing part 250*b*.

In detail, the guide recessed part 310 is opened downward and extends along the insertion direction of the paper discharge device 300 in a plan view. The guide recessed part 310 has a concave shape corresponding to the convex shape of the protruding tray 150 when viewed from the insertion direction (that is, the paper discharge direction) of the paper discharge device 300. The aforementioned guide recessed part 310 is formed by an upper surface 311 and a side surface 312 connected to a peripheral edge of the upper surface 311. The side surface 312 of the guide recessed part includes a pair of side wall surfaces 312*a* (see FIG. 3) extending in the insertion direction of the paper discharge device 300, a front end surface 312*b* for connecting front side ends of the pair of side wall surfaces 312*a* in the aforementioned insertion direction to each other, and a rear end surface 312*c* for connecting rear side ends of the pair of side wall surfaces 312*a* in the aforementioned insertion direction to each other. The pair of side wall surfaces 312*a* and the rear end surface 312*c* are slightly inclined downward and outward from the guide recessed part 310. The front end surface 312*b* is inclined downward and outward from the guide recessed part 310 at an angle sharper than those of the side wall surfaces 312*a* and the rear end surface 312*c*. In other words, the front end surface 312*b* is inclined downward and toward the front side in the insertion direction. Preferably, the inclination angle of the front end surface 312*b* is in the range of 25° to 35°, and is set to 30° in the present embodiment.

Figure 4:
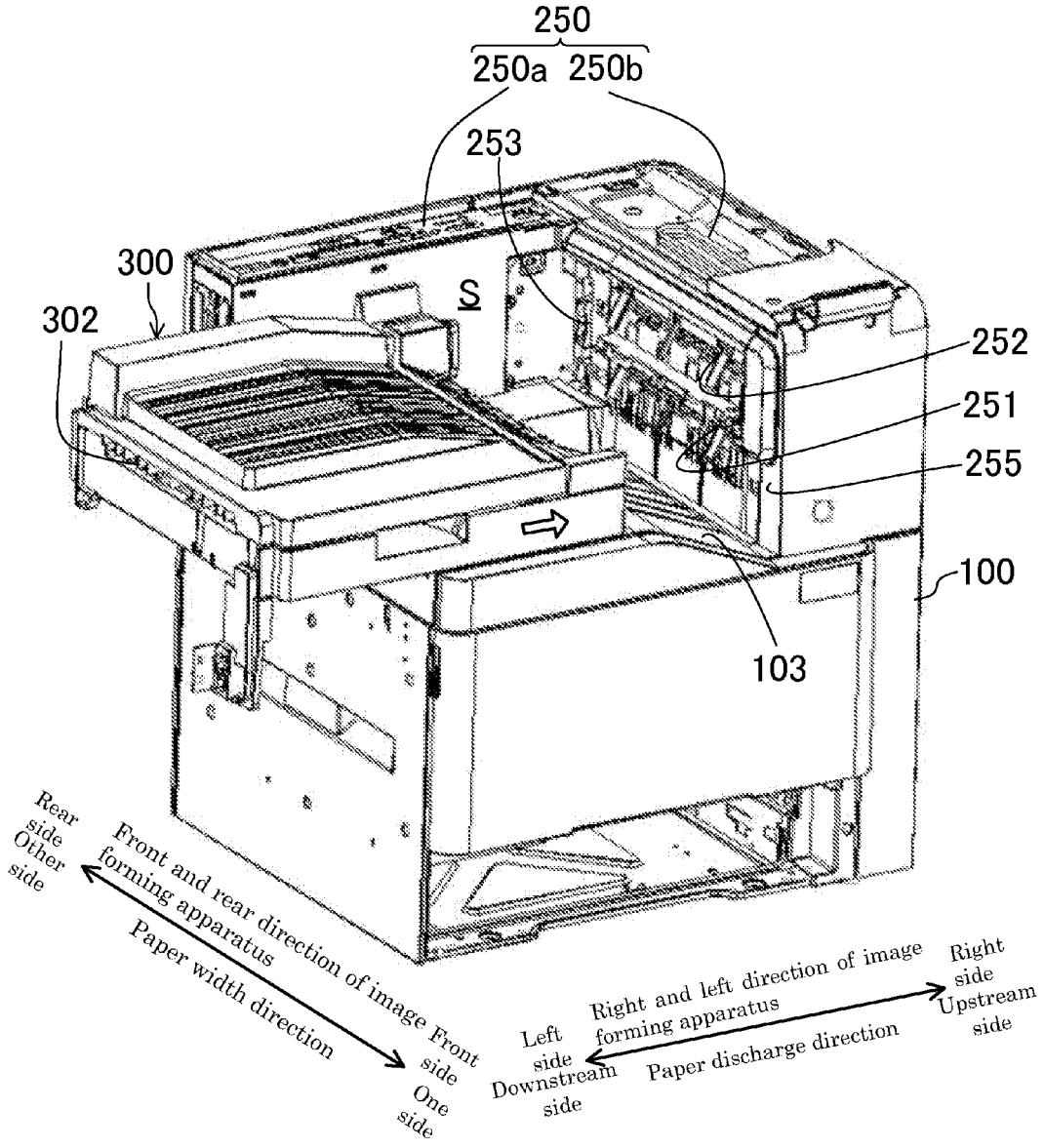
FIG. 4 is an explanation diagram for explaining a mounting method of a paper conveying device.
Figure 5:
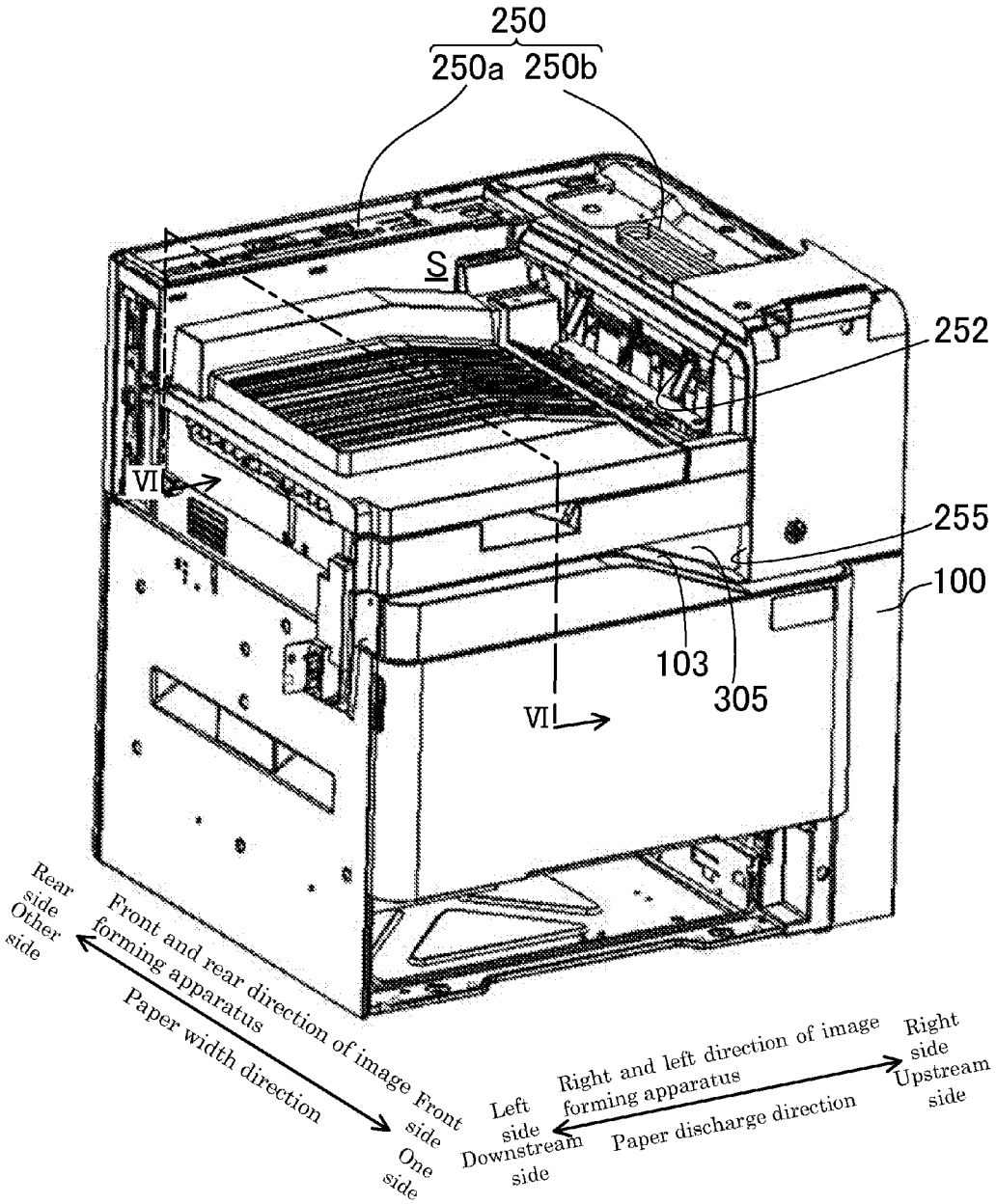
FIG. 5 is an explanation diagram for explaining a mounting method of a paper conveying device.

As illustrated in FIG. 4, when the paper discharge device 300 is mounted in the in-body paper discharge space S, the front end portion of the paper discharge device 300 in the insertion direction is temporarily placed on the horizontal surface portion 102 of the paper tray 101, and then the paper discharge device 300 is allowed to slide in a direction indicated by a white arrow of the drawing. Then, as illustrated in FIG. 5, the lower projecting plate 305 of the paper discharge device 300 is fitted into the V-shaped recessed part, so that the mounting of the paper discharge device 300 is completed.

In the aforementioned embodiment, when the paper discharge device 300 is mounted in the in-body paper discharge space S, the protruding tray 150 serves as a guide member. That is, the guide recessed part 310 having the concave shape corresponding to the convex shape of the protruding tray 150 is formed at the lower surface of the paper discharge device 300, and when the paper discharge device 300 is mounted in the in-body paper discharge space S, the guide recessed part 310 is engaged with the protruding tray 150 to guide the paper discharge device 300. In this way, when the paper discharge device 300 is inserted into the in-body paper discharge space S, it is possible to prevent the position of the paper discharge device 300 from being deviated from a predetermined position in the paper width direction. Accordingly, the position deviation of the electrical connector 306 of the paper discharge device 300 and the supply-side electrical connector 253 is prevented, so that it is possible to allow both electrical connectors 253 and 306 to be reliably fitted into each other. Thus, it is possible to reliably prevent fitting failure of both electrical connectors 253 and 306.

Furthermore, in the aforementioned embodiment, the front end surface 312*b* of the aforementioned guide recessed part 310 in the device insertion direction is inclined downward toward the front side in the device insertion direction.

According to the above, when the paper discharge device 300 is inserted into the in-body paper discharge space S, the guide recessed part 310 can be gradually and smoothly engaged with the protruding tray 150. Thus, as compared with the case in which the front end surface 312*b* of the guide recessed part 310 is not inclined, it is possible to easily perform the mounting work (the insertion work) of the paper discharge device 300.

Furthermore, in the aforementioned embodiment, the protruding tray 150 is configured to be detachable from the upper surface of the body casing part 100.

According to such a configuration, the protruding tray 150 is detached according to necessity, so that it is possible to widen the space of the in-body paper discharge space S. In the case in which the lower surface of the paper discharge device 300 is formed in a flat shape as the conventional art, when the paper discharge device 300 is mounted in the in-body paper discharge space S, it is necessary to detach the protruding tray 150. However, in the aforementioned embodiment, the guide recessed part 310 is configured to be formed in the lower surface of the paper discharge device 300, so that it is possible to perform the mounting work of the paper discharge device 300 without detaching the protruding tray 150. Thus, it is possible to reduce the inconvenience of a user and to shorten a time required for the mounting work. Furthermore, in the aforementioned embodiment, the protruding tray 150 is configured to be used as a guide member of the paper discharge device 300, so that it is possible to reduce the product cost by reducing the number of parts as compared with the case in which a guide member is separately provided.

Other Embodiments

In the aforementioned embodiment, the example in which the image forming apparatus 1 is a copy machine has been described; however, the present technology is not limited thereto. The image forming apparatus 1, for example, may also be a printer, a facsimile, a multifunctional peripheral and the like.

In the aforementioned embodiment, the example in which the protruding tray 150 is detachable from the upper surface of the body casing part 100 has been described; however, the present technology is not limited thereto. The protruding tray 150, for example, may also be integrally formed with the upper surface of the body casing part 100.

What is claimed is:

1. An image forming apparatus comprising:

a body casing part that accommodates an image forming unit which performs an image forming process on a paper;

a scanner casing part provided above the body casing part and accommodating an image reading unit;

a connection casing part having a paper discharge port for discharging the paper subjected to the image forming process and connecting the body casing part to the scanner casing part; and an in-body paper discharge space surrounded by a wall part formed with the paper discharge port in the connection casing part, an upper surface portion of the body casing part, and a bottom surface portion of the scanner casing part, wherein the in-body paper discharge space is configured such that a paper conveying device is attachable and detachable, and the image forming apparatus further comprises:

a protruding tray part provided on the upper surface portion of the body casing part, extending in a paper discharge direction and having a convex shape projecting upward when viewed from the paper discharge direction, and supporting a part of a lower surface of the paper, which is discharged from the paper discharge port, from below, thereby forming a space between end portions of the paper and the upper surface portion of the body casing part, wherein the paper conveying device is formed at a lower surface thereof with a guide recessed part which has a concave shape corresponding to the convex shape of the protruding tray part, and is engaged with the protruding tray part to guide the paper conveying device when the paper conveying device is mounted in the in-body paper discharge space.

2. The image forming apparatus of claim 1, wherein the paper conveying device is inserted into the in-body paper discharge space along the paper discharge direction from an outer side of the in-body paper discharge space, and a front end portion of the guide recessed part in a device insertion direction is provided with an inclination surface inclined downward toward a front side in the device insertion direction.

3. The image forming apparatus of claim 2, wherein an electrical connector is exposed from a front surface of the paper conveying device in the device insertion direction, a supply-side electrical connector fitted into the electrical connector of the paper conveying device to supply the electrical connector with power is exposed to a surface part of the connection casing part, which faces the in-body paper discharge space, and the guide recessed part is formed so as to guide the paper conveying device such that the electrical connector of the paper conveying device is fitted into the supply-side electrical connector.

4. The image forming apparatus of claim 1, wherein the protruding tray part is attachable and detachable from an upper surface of the body casing part.

* * * * *